US011810529B2

(12) United States Patent
Hu et al.

(10) Patent No.: US 11,810,529 B2
(45) Date of Patent: Nov. 7, 2023

(54) SCREEN COLOR GAMUT CONTROL METHOD, ELECTRONIC DEVICE AND STORAGE MEDIUM

(71) Applicant: GUANGDONG OPPO MOBILE TELECOMMUNICATIONS CORP., LTD., Dongguan (CN)

(72) Inventors: Jie Hu, Dongguan (CN); Xiaori Yuan, Dongguan (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 94 days.

(21) Appl. No.: 17/576,651

(22) Filed: Jan. 14, 2022

(65) Prior Publication Data

US 2022/0139354 A1 May 5, 2022

Related U.S. Application Data

(63) Continuation of application No. PCT/CN2020/099100, filed on Jun. 30, 2020.

(30) Foreign Application Priority Data

Jul. 17, 2019 (CN) ..... 201910647563.2

(51) Int. Cl.
*G09G 5/02* (2006.01)
*G09G 5/00* (2006.01)

(52) U.S. Cl.
CPC ..... *G09G 5/024* (2013.01); *G09G 5/006* (2013.01); *G09G 2320/0666* (2013.01); *G09G 2320/08* (2013.01); *G09G 2340/06* (2013.01)

(58) Field of Classification Search
None
See application file for complete search history.

(56) References Cited

U.S. PATENT DOCUMENTS

2006/0285136 A1 12/2006 Shin et al.
2009/0147018 A1* 6/2009 Takei ..... H04N 23/633 348/222.1

(Continued)

FOREIGN PATENT DOCUMENTS

CN 104239076 A 12/2014
CN 104267885 A 1/2015

(Continued)

OTHER PUBLICATIONS

The partial supplementary European search report dated Jul. 13, 2022 from European Patent Application No. 20841297.3.

(Continued)

*Primary Examiner* — Yingchun He
(74) *Attorney, Agent, or Firm* — BAYES PLLC

(57) ABSTRACT

Disclosed in embodiments of the present application are a screen color gamut control method and apparatus, an electronic device, and a storage medium. The method comprises: displaying a control, the control being configured to control the screen to switch between different color gamut spaces; acquiring the state of the control, the state being used for representing the color gamut space to which the screen is controlled to switch; and adjusting the color gamut space of the screen to make same be switched to the color gamut space corresponding to the state of the control. By means of the present method, when the control is displayed, the color gamut space of the screen is adjusted by the control to switch the color gamut space to that corresponding to the state of the control, so that users can enjoy different color experiences, thereby improving user experience.

9 Claims, 9 Drawing Sheets

(56) References Cited

U.S. PATENT DOCUMENTS

| | | | | |
|---|---|---|---|---|
| 2010/0271386 | A1* | 10/2010 | Lee | H04N 5/20 345/589 |
| 2011/0205259 | A1 | 8/2011 | Hagood, IV | |
| 2013/0076776 | A1 | 3/2013 | Glen et al. | |
| 2015/0015621 | A1 | 1/2015 | Atkinson | |
| 2016/0210891 | A1* | 7/2016 | Zhang | G09G 3/2003 |
| 2016/0247437 | A1* | 8/2016 | Choi | G09G 3/2003 |
| 2017/0301275 | A1 | 10/2017 | Wang et al. | |
| 2021/0216199 | A1 | 7/2021 | Lin | |

FOREIGN PATENT DOCUMENTS

| | | | | |
|---|---|---|---|---|
| CN | 105118026 | A | | 12/2015 |
| CN | 105261326 | A | | 1/2016 |
| CN | 105590591 | A | | 5/2016 |
| CN | 106710505 | A | | 5/2017 |
| CN | 106782428 | A | * | 5/2017 |
| CN | 106782428 | A | | 5/2017 |
| CN | 107680556 | A | | 2/2018 |
| CN | 107945744 | A | | 4/2018 |
| CN | 109151573 | A | | 1/2019 |
| CN | 110389696 | A | | 10/2019 |
| JP | 2007171408 | A | | 7/2007 |
| JP | 2011166731 | A | | 8/2011 |
| KR | 20170024847 | A | | 3/2017 |

OTHER PUBLICATIONS

The supplementary European search report dated Dec. 1, 2022 from European patent application No. 20841297.3.

International Search Report and the Written Opinion dated Sep. 27, 2020 From the International Searching Authority Re. Application No. PCT/CN2020/099100, 13 pages.

The first Office Action dated Jul. 22, 2020 from from China Application No. 201910647563.2, 19 pages.

The second Office Action dated Dec. 16, 2020 from from China Application No. 201910647563.2, 18 pages.

Notice of Allowance dated Mar. 11, 2021 from from China Application No. 201910647563.2, 5 pages.

How to Change Screen Color in OnePlus 6, URL:http://mydown.yesky.com/news/87378831.html, Feb. 23, 2019.

* cited by examiner

SCREEN COLOR GAMUT CONTROL METHOD, ELECTRONIC DEVICE AND STORAGE MEDIUM

CROSS-REFERENCE TO RELATED APPLICATIONS

This application is a continuation of International Application No. PCT/CN2020/099100, filed on Jun. 30, 2020, and claims priority to Chinese application No. 201910647563.2, filed on Jul. 17, 2019, the entire contents of which are incorporated herein by reference in their entireties.

BACKGROUND OF DISCLOSURE

Field of the Disclosure

The present disclosure relates to the technical field of image processing, and more specifically to a method, an apparatus, an electronic device, and a storage medium for controlling screen color gamut.

Description of the Related Art

In the display field, a color gamut represents a range of colors that a specific device can express, that is, various screen display devices, printers, or printing devices can express a color range. If the color gamut of the device is larger, the ability to display colors is stronger, and the display effect is better. However, in the process of displaying photos of different colors, an electronic device not only needs to display color and brightness of a photo but also needs to display the energy of other colors required by a picture, resulting in high display power consumption of the electronic device.

SUMMARY

In view of the above problems, the present disclosure proposes a method, an apparatus, an electronic device, and a storage medium for controlling screen color gamut to improve the above problems.

In a first aspect, an embodiment of the present disclosure provides a screen color gamut control method applied to an electronic device having a screen supporting image display based on multiple color gamut spaces, wherein the method includes: displaying a control member configured to switch color gamut spaces of the screen; acquiring a state of the control member, the state being configured to represent a color gamut space of the screen switched to; and switching the color gamut space of the screen to a color gamut space corresponding to the state of the control member.

In a second aspect, an embodiment of the present disclosure provides a screen color gamut control apparatus operating in an electronic device having a screen supporting image display based on multiple color gamut spaces, wherein the apparatus includes: a display module configured to display a control member configured to switch color gamut spaces of the screen; a state acquisition module configured to acquire a state of the control member the state being configured to represent a color gamut space of the screen switched to; and a color-gamut-space adjustment module configured to switch a color gamut space of the screen to a color gamut space corresponding to the state of the control member.

In a third aspect, an embodiment of the present disclosure provides an electronic device including one or more processors and a memory configured to store instructions which, when executed by the one or more processors, cause the one or more processors to: display a control member configured to switch color gamut spaces of the screen; acquire a state of the control member, the state being configured to represent a color gamut space of the screen switched to; and switch the color gamut space of the screen to a color gamut space corresponding to the state of the control member.

In a fourth aspect, an embodiment of the present disclosure provides a computer-readable storage medium having stored therein instructions that, when executed by a processor, cause the processor to: display a control member configured to switch color gamut spaces of the screen; acquire a state of the control member, the state being configured to represent a color gamut space of the screen switched to; and switch the color gamut space of the screen to a color gamut space corresponding to the state of the control member.

BRIEF DESCRIPTION OF DRAWINGS

To illustrate technical solutions in the embodiments of the present disclosure more clearly, drawings that are used in the description of the embodiments are briefly introduced as follows. Obviously, the drawings in the following description are only some embodiments of the present disclosure. For those skilled in the art, other drawings can also be obtained from these drawings without creative effort.

DETAILED DESCRIPTION OF EMBODIMENTS

Figure 1:
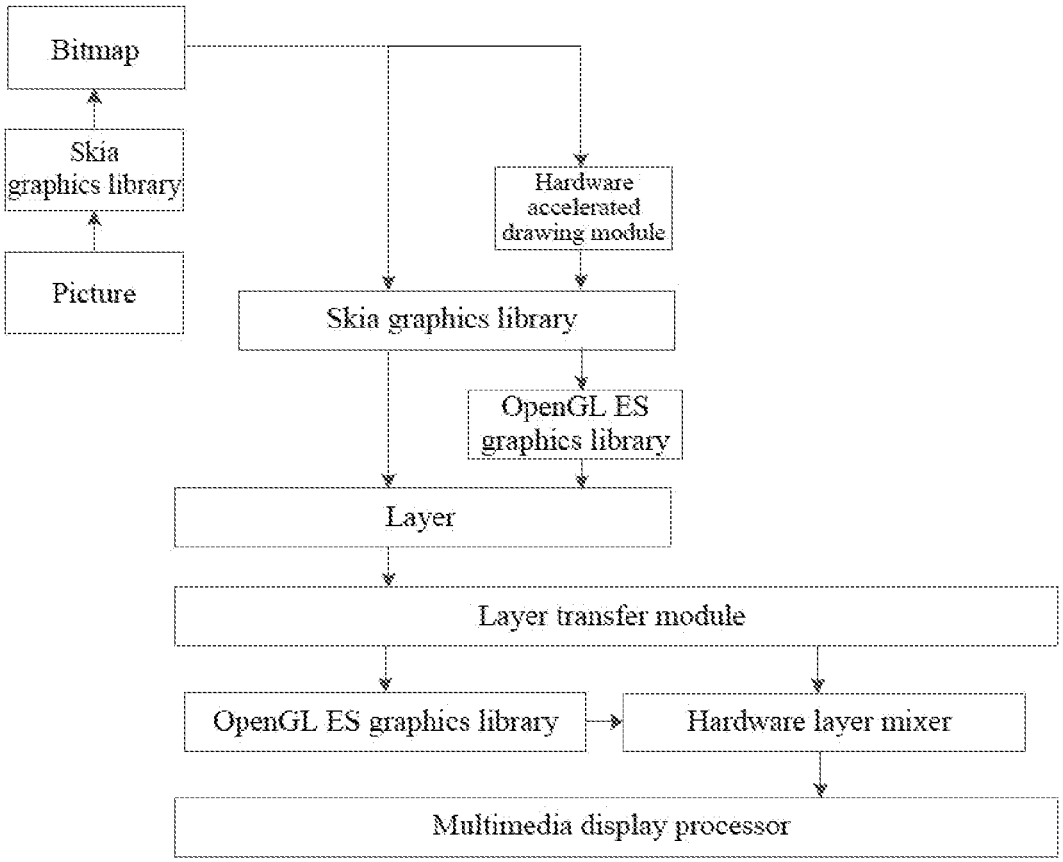
FIG. 1 shows a diagram of an image processing environment provided by an embodiment of the present disclosure.

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by those of ordinary skill in the art without creative work fall within the protection scope of the present disclosure.

With the improvement of the hardware performance of electronic devices, more electronic devices can display pictures with higher definition and rich colors. However, the inventor found in the research that in a process of displaying pictures of different colors, not only need to display color and brightness of a photo but also needs to display the energy of other colors required by a picture, resulting in high display power consumption of the electronic device.

Color gamut spaces are taken as an example. Color gamut, i.e., color gamut space, is a method of encoding a color, and also refers to a sum of colors that a technical system can produce. In computer graphics, a color gamut is some complete subset of colors. The color gamut space can include sRGB color gamut, Adobe RGB color gamut or DCI-P3 color gamut. sRGB is one of the earliest color gamut standards and has been supported by W3C, Exif, Intel, Pantone, Corel, and many other industry manufacturers from the industry. Adobe RGB color gamut is mainly to improve display on the cyan color system, so it can cover about 50% of the CIE 1931 XYZ color space. DCI-P3 is a color gamut used in digital cinema. It is a color gamut standard dominated by human visual experience, which matches as much as possible full-color gamut that can be displayed in movie scenes. It is also not the widest color gamut standard (presently the latest standard is BT.2020), but it has a wider red/green color range better than Rec.709 standard.

The inventor found that when a color gamut space of a screen and a color gamut space configured on an interface are always consistent, although display effect when a picture was originally captured and display effect when the interface was originally designed can be better displayed but will result in high power consumption of the terminal, such as excessive power consumption of the terminal, short standby time, frequent charging, and the like, resulting in a bad user experience.

Therefore, in order to improve the above-mentioned problems, the inventor proposes a screen color gamut control method, apparatus, electronic device, and storage medium of the present disclosure that can make a color gamut space of the screen be adjusted by switching the control member to a color gamut space corresponding to the state of the control member under a case that the control member is displayed, so that the user can enjoy various color experiences and enhance user experience.

The environment in which the embodiments of the present disclosure operate will be first introduced below.

As shown in FIG. 1, in the embodiment of the present disclosure, a color gamut conversion process in an interface (for example, activity) is performed in a canvas (Canvas), wherein the interface to be subjected to color gamut conversion will first be processed by the graphics processing function library (Skia) to obtain a corresponding bitmap, and then perform color gamut conversion based on the bitmap. In the color gamut conversion process, the color gamut conversion will be performed based on the hardware accelerated drawing (rendering) module (HWUI) or the graphics processing function library (Skia), and then be processed by OpenGL ES (a graphics library), layer module (Surface), layer transfer module (Surface Flinger), hardware layer mixer (HWC), and multimedia display processor (MDP), and finally be displayed on the screen.

The embodiments of the present disclosure will be described in detail below with reference to the accompanying drawings.

Figure 2:
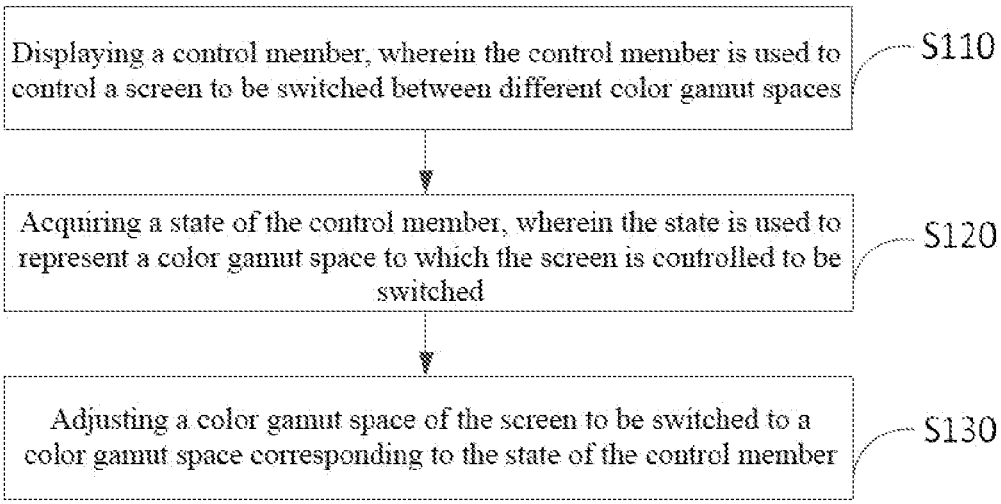
FIG. 2 shows a method flowchart of a screen color gamut control method proposed by an embodiment of the present disclosure.

Referring to FIG. 2, a screen color gamut control method provided by an embodiment of the present disclosure is applied to an electronic device having a screen that supports image display based on multiple color gamut spaces, and the method includes:

Step S110: displaying a control member used to control a screen to be switched between different color gamut spaces.

In this embodiment, the control member can be displayed in various situations.

It can be understood that in the process of adapting a color gamut space of the screen to the color gamut space configured by a display interface of the electronic device, the color gamut space configured by different display interfaces of the electronic device are not the same. The screen is then required to switch back and forth between different color gamut spaces, which will consume processor resources and power resources. In addition, for some display interfaces with high-frequency changes of image content (such as playing movies, game videos, and the like), the color gamut spaces of the screen will be switched more frequently, potentially affecting the resources and power consumption of electronic devices more.

In addition, the control member will also consume power of the electronic device in the process of the control member being displayed by the electronic device. For some display interfaces of the electronic device, it may not need to enhance the display effect of the displayed content. For example, when PPT text content is playing or when a novel is read, only the words need to be read clearly. In this case, if the control member is still displayed on the display interface, it will be a bit wasteful, and may also affect the user's visual experience.

Then, in order to reduce resource consumption and reduce the power consumption of the electronic device, as a method, preset conditions can be set so that the electronic device displays the control member only when the preset conditions are satisfied, so that the user can control the screen via the control member to be switched between different gamut spaces. The preset conditions represent that present resources of the electronic device allow displaying the control member. The resources of the electronic device may include present processing resources or power of the electronic device, and the like.

In one implementation, a central processing unit (CPU) occupancy threshold can be configured for processing resources. When the electronic device detects that a present CPU occupancy is lower than the aforementioned occupancy threshold, it indicates that the present CPU is running at a low load, and then the control member can be displayed. Similarly, regarding power, a power threshold range can also be configured. When the electronic device detects that the present power is within the power threshold range, it indicates that the present power of the electronic device is sufficient, and the color gamut of the screen can be adjusted to enhance image content or reduce the power consumption of the electronic device. Then, in this case, the control member can be displayed.

In another implementation manner, the preset conditions may represent whether the present electronic device has turned on a display a control member. Optionally, if displaying the control member is turned on, the control member may be displayed on a corresponding display interface; otherwise, the control member is not displayed.

Figure 3:
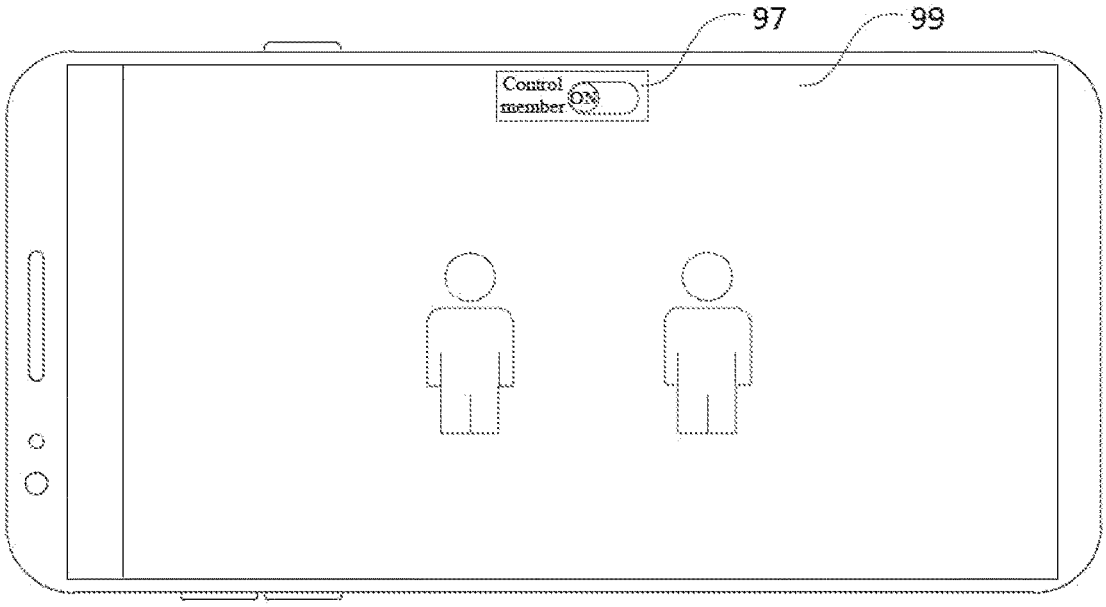
FIG. 3 shows a schematic diagram of a control member in a screen color gamut control method proposed by an embodiment of the present disclosure.

In this embodiment, the control member can be displayed in various styles. For example, as shown in FIG. 3, which is a schematic diagram of displaying a control member, in an interface 99, a control member 97 is displayed floatingly, and the user can touch the control member 97 to make the control member 97 represent whether the color gamut of the screen is performed to be switched between two states. The number of control member 97 can be one or more (only one is shown in the figure), and a display position of the control member 97 can be located at any position of the interface 99 (for example, located on the top, bottom, left, and right side or a position of a certain angle of the display interface of the electronic device, and the like), which is not limited here.

As one way, in order to enhance the user experience, after the electronic device displays the control member 97, the user can slide the control member 97 to move the control member 97 out of the display interface of the electronic device, and when the user triggers the control member 97 again, the control member 97 can be displayed again in an above-described manner.

Step S120: acquiring a state of the control member, the state being used to represent a color gamut space the screen i switched to.

The control member may include a plurality of control members, and the state of the control member is used to represent a color gamut space to which the screen is controlled to be switched. The screen corresponding to different control members is switched to different color gamut spaces, that is, each control member can be configured to a screen color gamut space.

For example, if there are control members A, B, and C, then the control member A can be configured to correspond to an sRGB color gamut, the control member B can be configured to correspond to an Adobe RGB color gamut, and the control member C can be configured to correspond to a DCI-P3 color gamut. It can be understood that by obtaining the state of the control member, the color gamut space to which the present screen needs to be switched can be obtained. Optionally, if it is detected that the control member A is in a turned-on state, the control screen will be switched to the sRGB color gamut. If the control member B is detected to be in a turned-on state, the control screen will be switched to the Adobe RGB color gamut. If the control member C is in a turned-on state, the control screen will be switched to the DCI-P3 color gamut.

As one way, a present state of the control member can be determined by detecting a touch state of the control member. For example, as in the above example, if it is detected that the control member A is in the turned-on state after being touched, then the present state of the control member is the sRGB color gamut. Similarly, if it is detected that the control member B is in the turned-on state after being touched, then the present state of the control member is the Adobe RGB color gamut. If it is detected that the control member C is in the turned-on state after being touched, then the present state of the control member is the DCI-P3 color gamut.

As another way, a variable can be created for the electronic device, and a variable value can then be used to represent the state of the control member. For example, if the variable value is 1, it means that the state of the control member is a state corresponding to the control member whose variable value is 1. It can be understood that at the same time, there is only one control member's state corresponding to the variable value of 1. The variable value corresponding to the other control member's state is 0. Then, in this case, when it is detected that the variable value corresponding to the state of the control member is 1, the state of the control member will be acquired.

Step S130: switching the color gamut space of the screen t to a color gamut space corresponding to the state of the control member.

As one way, after acquiring the state of the control member, the electronic device can adjust a color gamut space of the screen to be switched to a color gamut space corresponding to the state of the control member, so that a color gamut space of the screen can be consistent with the color gamut space configured on the display interface. Alternatively, a color gamut space of the screen can be adjusted to a color gamut space that satisfies the user's visual experience requirements, so that the user can experience switching back and forth between different color gamut spaces of the screen, enhancing the fun of use.

A screen color gamut control method provided by the present disclosure, by displaying a control member configured to switch color gamut spaces of the screen, and then acquiring a state of the control member, wherein the state is configured to represent a color gamut space of the screen switched to, and then switching the color gamut space of the screen to a color gamut space corresponding to the state of the control member. Therefore, by the above means, in a case that the control member is displayed, a color gamut space of the screen is adjusted by the control member to switch the color gamut space to that corresponding to the state of the control member, so that users can enjoy different color experiences, thereby improving user experience.

Figure 4:
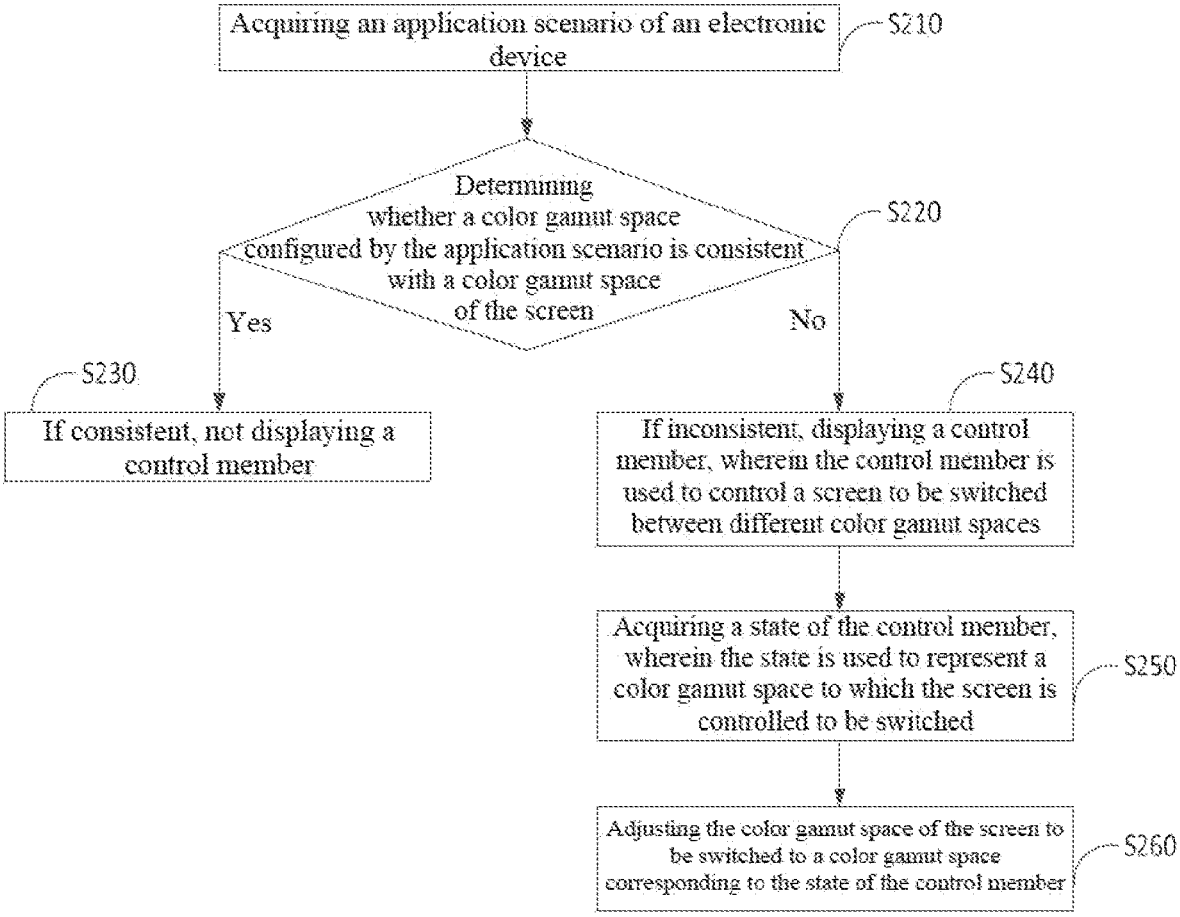
FIG. 4 shows a method flowchart of a screen color gamut control method proposed by another embodiment of the present disclosure.

Referring to FIG. 4, a screen color gamut control method provided by an embodiment of the present disclosure is applied to an electronic device having a screen, wherein the screen supports image display based on multiple color gamut spaces, and the method includes:

Step S210: acquiring an application scenario of an electronic device.

In one way, the application scenario is a content scene corresponding to an application program displayed on a display interface of the electronic device. Different application programs may include different content scenes. The same application program changes with the content displayed at different times or may include different content scenarios.

Figure 5:
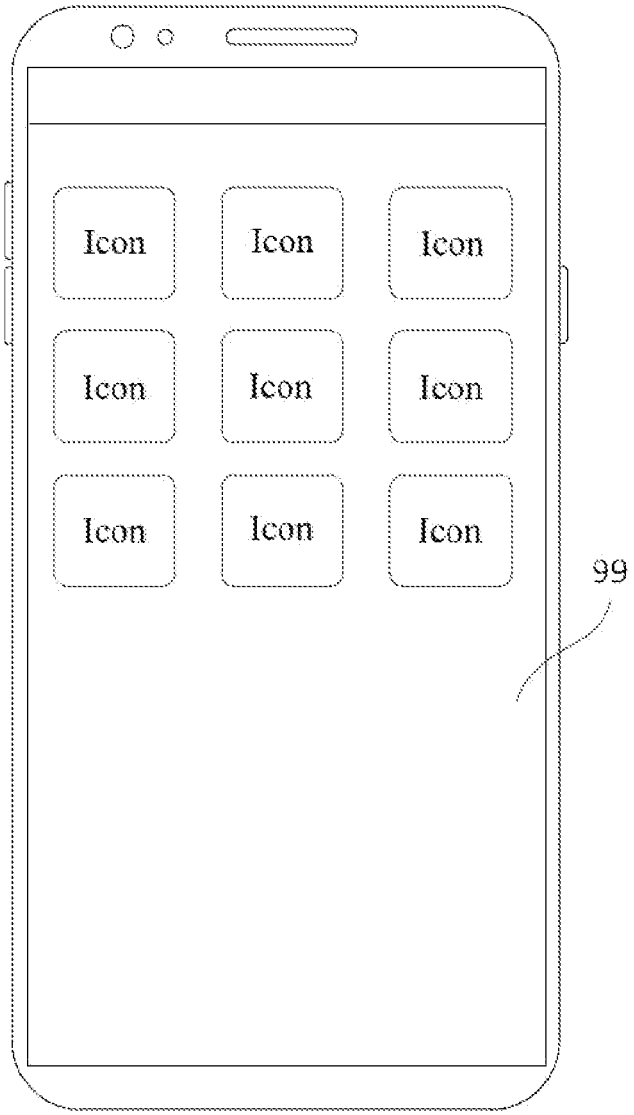
FIG. 5 shows a schematic display diagram of an application program of an electronic device in a screen color gamut control method proposed by an embodiment of the present disclosure.

For example, as shown in FIG. 5, there are multiple icons displayed on an interface 99, and different icons indicate that different application scenarios are turned on. Optionally, the icon may be an icon of a single application program or may include folder icons of multiple application programs. For example, a folder named "Game Collection" can place for application programs that belong to the same category of games, wherein a naming method of the folder is not limited. In this case, a corresponding application scenario can be obtained by detecting whether the icon is selected. Optionally, after detecting that an icon is touched by the user, an application scenario corresponding to the application program represented by the icon may be acquired.

Step S220: determining whether a color gamut space configured by the application scenario is consistent with a color gamut space of a screen.

The electronic device can acquire the color gamut space of the application scenario in various ways.

The color gamut space configured for different application scenarios may be different, and the color gamut space configured for different content display interfaces of the same application scenario may also be different. As one way, for a selected application scenario, a color gamut space corresponding to a present display interface or all content interfaces of an application program corresponding to the application scenario can be acquired. For example, a configuration file can be established to store the color gamut spaces corresponding to all content interfaces. The configuration file can be encapsulated in an installation file of the application program, e.g., in an apk file of the Android system. Then, in this way, the electronic device can acquire the color gamut space corresponding to all content interfaces of the application program by reading the configuration file of the application program.

As another way, a configuration file of some application programs can only be accessed by the application program itself. In a case of storing the color gamut space corresponding to all content interfaces of the application program through the configuration file, the electronic device may not be able to effectively acquire the configured color gamut space for all content interfaces in the application program. In this case, a public configuration file that can be accessed by third-party application programs other than a system program can be established in the electronic device. The public configuration file can be used to store some non-confidential information, e.g., a developer of the application program, a version number of the application program, or a color gamut space configured by the application program. In this way, when it is detected that an application program is installed, the installed application can actively store the developer of the application program, the version number of the application program, or the color gamut space configured by the application program into the public configuration file. Certainly, during storing, an identifier of the application program is also stored so that the application program to which the information stored in the public configuration file belongs can be identified. The identifier of the application program may be a package name.

Based on the above method, when the electronic device needs to acquire the color gamut space of a certain interface of a certain application program, it can be realized by querying the aforementioned public configuration file, so as to realize that even if the electronic device cannot directly acquire the configuration file of the application program itself, the color gamut space configured for all content interfaces in the application program can still be acquired.

It should be noted that the information stored in the aforementioned public configuration file is not limited to the developer of the application program, the version number of the application program, or the color gamut space configured by the application program, etc., which are exemplarily indicated above, and may also include more information. For example, it may also include permission information, that the application needs to acquire, and the like.

In this embodiment, as one way, a file can be configured in the system of the electronic device to store the present color gamut space of the screen, then in this way, the electronic device can acquire a color gamut space of the screen by reading the file.

It can be understood that whether the color gamut space configured in the application scenario is consistent with a color gamut space of the screen can be determined by comparing whether a color gamut space of the screen is consistent with the color gamut space configured in the acquired content interface of the application program.

Step S230: if consistent, not displaying a control member.

Optionally, if consistent, then there is no need to display the control member for the user to adjust a color gamut space of the screen, so that a power consumption problem caused by displaying the control member for a long time can be avoided.

Step S240: if inconsistent, displaying a control member used to control the screen to be switched between different color gamut spaces.

Optionally, if inconsistent, the control member will be displayed, so that the user can adjust a color gamut space of the screen through the control member, which satisfies the user's visual needs in a specific scene and improves the user experience.

Step S250: acquiring a state of the control member, wherein the state is used to represent a color gamut space of the screen switched to.

Step S260: adjusting the color gamut space of the screen to be switched to a color gamut space corresponding to the state of the control member.

In a screen color gamut control method provided by an embodiment of the present disclosure, by acquiring an application scenario of the electronic device, determining whether the color gamut space configured in the application scenario is consistent with a color gamut space of the screen, in a case of inconsistent, displaying the control member used to control the screen to be switched between different color gamut spaces, then acquiring a state of the control member, wherein the state is configured to represent a color gamut space of the screen switched to, and then switching the color gamut space of the screen to a color gamut space corresponding to the state of the control member. Therefore, in an above-mentioned manner, it is realized that in a case of determining that the color gamut space configured in the application scenario of the electronic device is inconsistent with a color gamut space of the screen, displaying the control member, by switching the control member to a color gamut space corresponding to the state of the control member, visual requirements of users in specific scenarios are satisfied, thereby improving the user experience.

Figure 6:
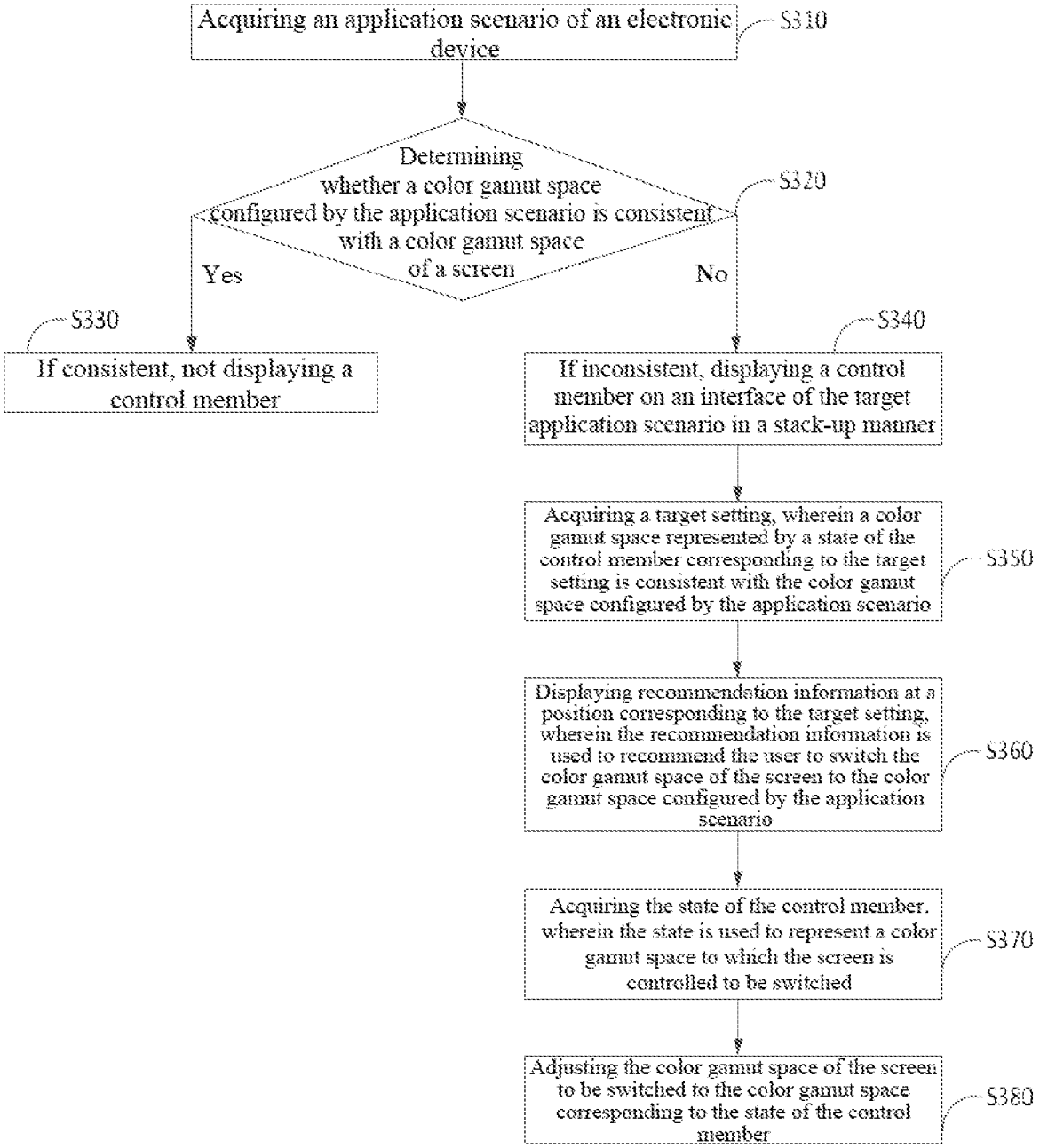
FIG. 6 shows a method flowchart of a screen color gamut control method proposed by another embodiment of the present disclosure.

Referring to FIG. 6, a screen color gamut control method provided by an embodiment of the present disclosure is applied to an electronic device having a screen that supports image display based on multiple color gamut spaces, and the method includes:

Step S310: acquiring an application scenario of an electronic device.

Step S320: determining whether a color gamut space configured by the application scenario is consistent with a color gamut space of a screen.

Step S330: if consistent, not displaying a control member.

Step S340: if inconsistent, displaying a control member on an interface of the target application scenario in a stack-up manner.

The target application scenario represents a scene that needs to adjust the screen color gamut to enhance the display effect of the content display interface of the application scenario. For example, the content scene included in some game or video application programs can be set as the target application scenario. The application scenario may also be other application scenarios in which the color display effect of the content displayed on the interface of the electronic device can be adjusted by adjusting the color gamut of the screen, which will not be listed one by one here. Optionally, the target application scenario can be identified by setting an identifier, so that when the user turns on an application program, the electronic device can identify whether the application program is an application program corresponding to the target application scenario. Optionally, if yes, then the electronic device will display the control member stack-up on the interface of the target application scenario.

As an implementation, when a certain application program is installed and applied, a specific identifier can be set, and the specific identifier can be stored with the configuration file of the application program. For example, a video/audio application program that members need to pay or recharge money can be identified as the application program corresponding to the target application scenario, then when the application program is turned on, the electronic device can read the configuration file to obtain whether an application program is the application program corresponding to the target application scenario.

Figure 7:
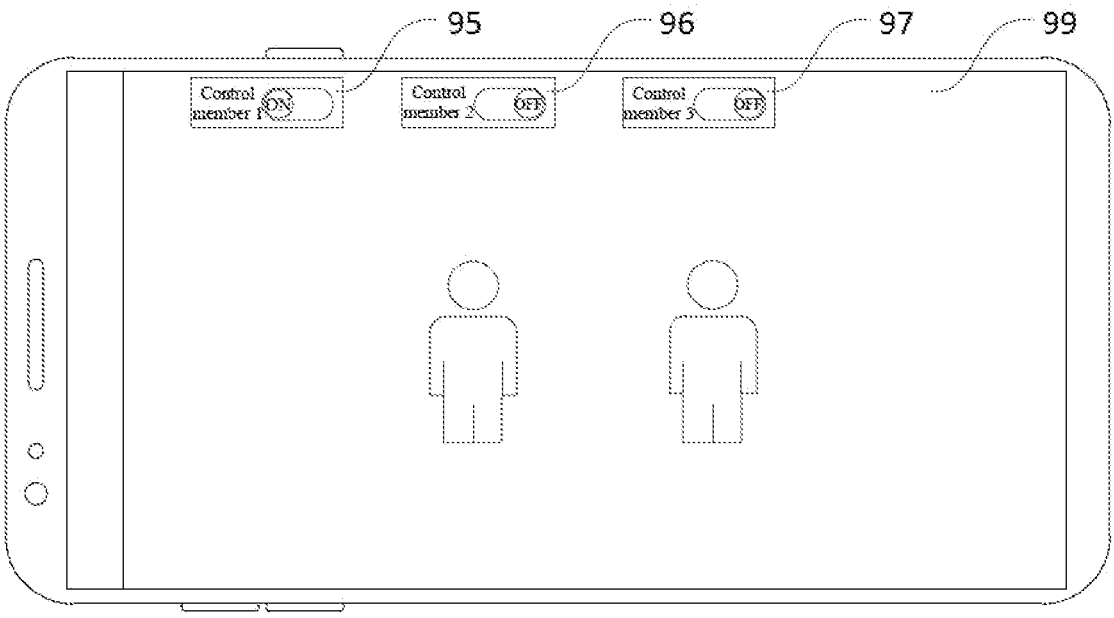
FIG. 7 shows a schematic display diagram of a control member in a screen color gamut control method proposed by an embodiment of the present disclosure.
Figure 8:
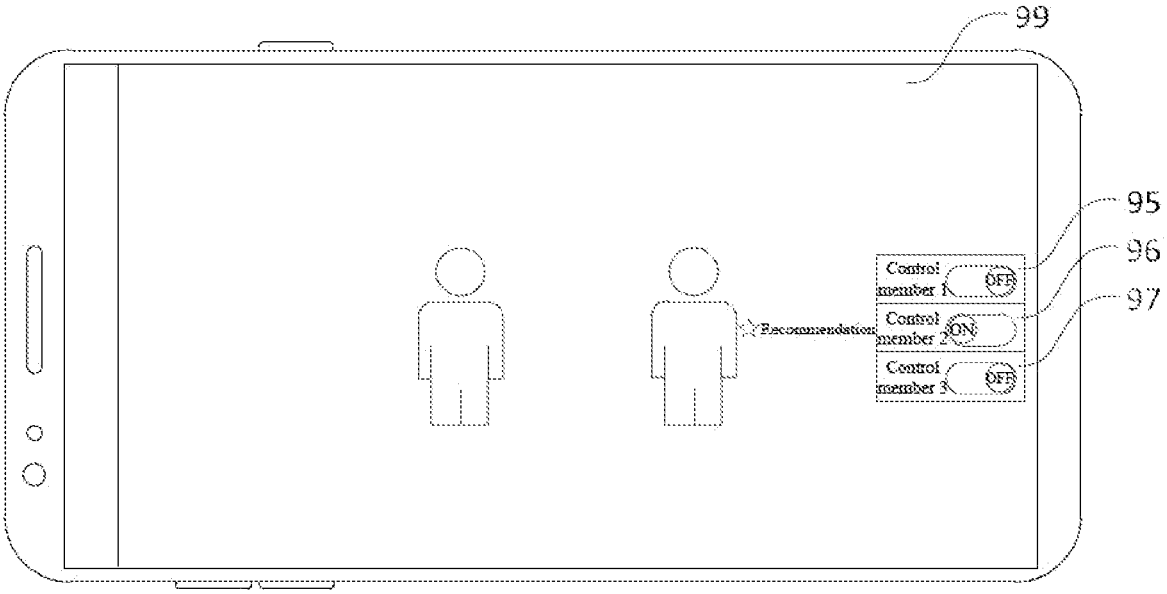
FIG. 8 shows another schematic display diagram of a control member in a screen color gamut control method proposed by an embodiment of the present disclosure.

As one way, as shown in FIG. 7, if inconsistent, a control member 95, a control member 96, and a control member 97 may be displayed in a floating manner on an interface 99 shown in FIG. 7. Optionally, the control member 95, the control member 96, and the control member 97 may be displayed in a floating manner on the right side of the interface 99, as shown in FIG. 8. It should be noted that a display position of the control member in the interface 99 is not limited and may be in any area.

By displaying a control member in a stacking manner, users can intuitively view the visual effects brought by switching to different screen color gamut spaces through the control member, so as to adjust the viewing effect suitable for the user and improve the user-friendly experience.

Step S350: acquiring a target setting, wherein a color gamut space represented by a state of the control member corresponding to the target setting is consistent with the color gamut space configured by the application scenario.

In this embodiment, the control member may include a plurality of settings, wherein each setting corresponds to a state of one control member. For example, as shown in FIGS. 7 and 8, control members may include control members 95, 96, and 97. The control members 95, 96, and 97 respectively correspond to one of the settings, and states of the control members corresponding to the control members 95, 96, and 97 are different.

It can be understood that the color gamut space of the content interface included in different application programs is different. For users, especially users who use for the first time, they may not understand the content interface of the application program what is the best color display effect? In this case, in order to avoid the user switching back and forth between different a control member to test which color effect is the most vivid and time-consuming, and also to enhance the user experience of the application program, the electronic device can determine the control member corresponding to a screen color gamut space consistent with a color gamut space as the target control member by acquiring the color gamut space configured by the content displayed on the current interface, thereby realizing acquisition of the target setting. The color gamut space represented by the state of the control member corresponding to the setting is consistent with the color gamut space configured in the application scenario.

Step S360: displaying recommendation information at a position corresponding to the target setting, wherein the recommendation information is used to recommend the user to switch the color gamut space of the screen to the color gamut space configured by the application scenario.

As one way, in order to facilitate the user to better identify the target setting, recommendation information can be displayed at a position corresponding to the target setting, and the user can switch a color gamut space of the screen to a color gamut space configured by the application scenario according to the recommendation information. The position corresponding to the target setting may be located on one side of the target setting, at a position surrounding the target setting, or at a position displaying the target setting itself (in this case, it can highlight the position of the target setting to remind the user that the target setting is a recommended setting).

For example, as shown in FIG. 8, the electronic device recognizes the setting where the control member 96 locates is the target setting. When the control member 96 is detected in a turned-on state, it will display something similar to "h Recommendation" on one side of the control member 96 that is easy for users to identify, so that users can quickly find the target setting, and then switch a color gamut space of the screen to a color gamut space configured by the application scenario. The format and content of the recommendation information are not limited here, and any format and content of the recommendation information that is convenient for users to distinguish are within a protection scope of the present disclosure.

Step S370: acquiring the state of the control member, wherein the state is used to represent a color gamut space of the screen switched to.

Step S380: adjusting the color gamut space of the screen to be switched to the color gamut space corresponding to the state of the control member.

In a screen color gamut control method provided by an embodiment of the present disclosure, by acquiring an application scenario of the electronic device, determining whether the color gamut space configured in the application scenario is consistent with a color gamut space of the screen, in a case of inconsistent, displaying a control member in a stack-up manner on an interface of the target application scenario, then acquiring a target setting and displaying recommendation information at a position corresponding to the target setting, wherein the recommendation information is configured to recommend the user to switch the color gamut space of the screen to the color gamut space configured by the application scenario, then acquiring a state of the control member, wherein the state is configured to represent a color gamut space of the screen switched to, and then switching the color gamut space of the screen to a color gamut space corresponding to the state of the control member. Therefore, in an above-mentioned manner, it is realized in a case of determining that the color gamut space configured in the application scenario of the electronic device is inconsistent with a color gamut space of the screen, displaying the control member in a stack-up manner, and then displaying the recommendation information at the position corresponding to the target setting, thereby implementing quickly switching a color gamut space of the screen to a color gamut space configured by the application scenario, reducing the time for user setting.

Figure 9:
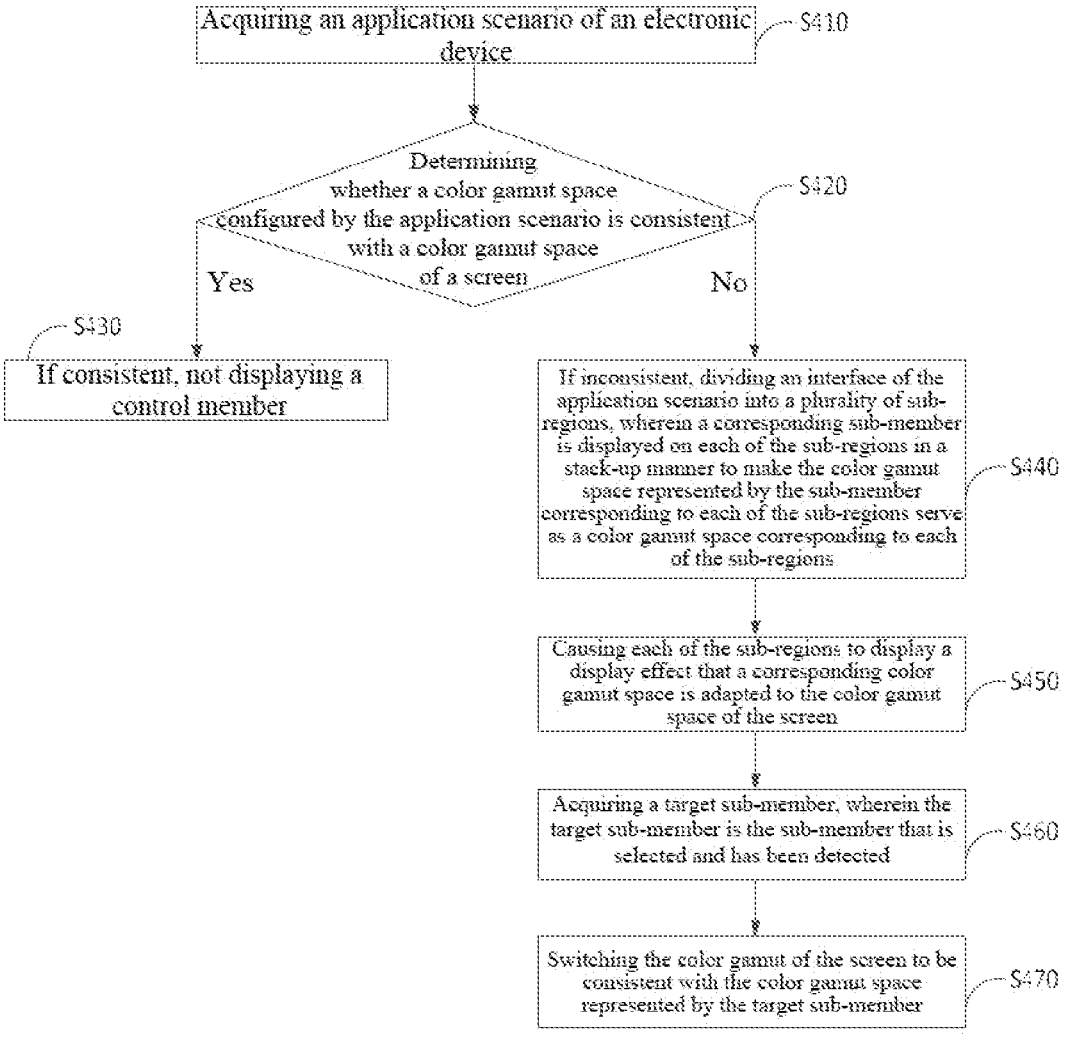
FIG. 9 shows a method flowchart of a screen color gamut control method proposed by still another embodiment of the present disclosure.

Referring to FIG. 9, a screen color gamut control method provided by an embodiment of the present disclosure is applied to an electronic device having a screen that supports image display based on multiple color gamut spaces, and the method includes:

Step S410: acquiring an application scenario of an electronic device.

Step S420: determining whether a color gamut space configured by the application scenario is consistent with a color gamut space of a screen.

Step S430: if consistent, not displaying a control member.

Step S440: if inconsistent, dividing an interface of the application scenario into a plurality of sub-regions, wherein a corresponding sub-member is displayed on each of the sub-regions in a stack-up manner to make the color gamut space represented by the sub-member corresponding to each of the sub-regions serve as a color gamut space corresponding to each of the sub-regions.

In this embodiment, the control member comprises a plurality of separate sub-members, each sub-member corresponds to one state of the control member. If the application scenario is a target application scenario, (wherein the specific description of the target application scenario may refer to the foregoing embodiments, which is not described again here), then in the case of determining that the color gamut space configured in the target application scenario is inconsistent with a color gamut space of the screen, the electronic device can divide the content display interface of the target application scenario into a plurality of sub-regions, displaying a corresponding sub-member on each sub-region in a stack-up manner, so that the color gamut space represented by the sub-member corresponding to each sub-region is used as the color gamut space corresponding to each sub-region.

As one way to divide the content display interface into a plurality of sub-regions, the original container for displaying the content display interface can be replaced with a plurality of independent and sequentially arranged containers. For example, the original container for displaying the content display interface is 210*30 in size. After dividing the content display interface into three sub-regions, the size container of 210*30 can be replaced with three containers with the size of 70*30. The container can be implemented in various ways, for example, it can be a VideoView component or an ImageView component in the Android system.

Then, after acquiring the content of the content display interface, the content is cut into the same number of copies as the plurality of independent and sequentially arranged containers, so as to realize that a respective displayed content of the plurality of independent and sequentially arranged containers is one of the sub-region in the original content display interface. It can be understood that, when the electronic device performs content cutting, the content is cut according to the respective sizes of the plurality of independent and sequentially arranged containers, so as to adapt to the size of each container.

It should be noted that the number of sub-members and the number of sub-regions are not limited, and each sub-region corresponds to a sub-member, and each sub-member corresponds to a screen color gamut.

Figure 10:
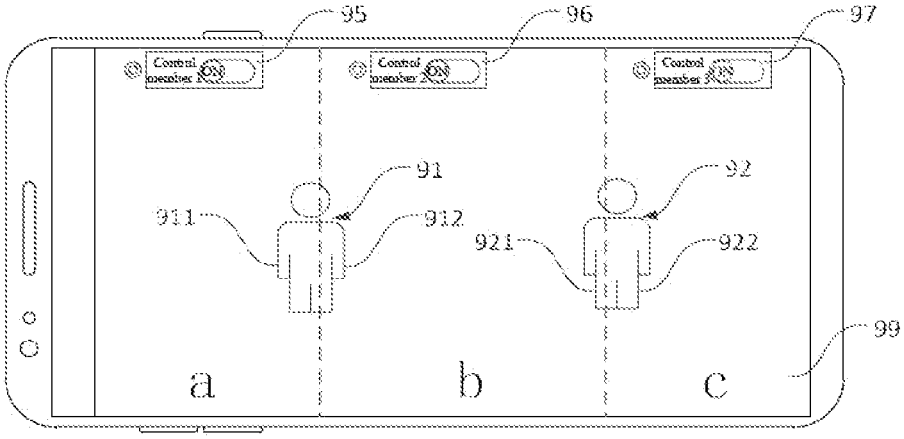
FIG. 10 shows yet another schematic display diagram of a control member in a screen color gamut control method proposed by an embodiment of the present disclosure.

For example, as shown in FIG. 10, an interface 99 includes sub-regions a, b, and c. Based on the foregoing example, sub-regions a, b, and c are displayed in different containers, respectively, the sub-region a is correspondingly displayed with a control member 95, the sub-region b is correspondingly displayed with a control member 96, and the sub-region c is correspondingly displayed with a control member 97. The user can make the control member 95, the control member 96, and the control member 97 be in a turned-on state by touching them, and then the interfaces of the sub-regions a, b, and c can be respectively seen that display effect after the color gamut space of the present content display interface is adapted to the screen color gamut corresponding to the state of the control members 95, 96, and 97, so that the desired display effect can be quickly selected to completely display the present content.

Step S450: causing each of the sub-regions to display a display effect that a corresponding color gamut space is adapted to the color gamut space of the screen.

Taking the above example as an example to illustrate, specifically, as shown in FIG. 10, for the case that the character 91 is located in the sub-region a and the sub-region b, and a character 92 is located in the sub-region b and the sub-region c, because the same image is located in different sub-regions at the same time. The display effect of the image within different sub-regions will also be different, that is, the display effect of image 911 and image 912, as shown in FIG. 10, are different. The display effect of image 921 and image 922 may be the same or different (if the overall color difference between an image 91 and an image 92 is large, e.g., when the image 91 is a red image and the image 92 is a blue image). In this way, the user can select a corresponding sub-region to display the display content of the present image as a whole according to his own visual needs and personal preferences.

Step S460: acquiring a target sub-member, wherein the target sub-member is the sub-member that is selected and has been detected.

As one way, the electronic device can also match the color gamut space configured on the interface of each sub-region with a color gamut space of the screen, and identify the control member corresponding to the consistent matching screen color gamut space as the target sub-member, Optionally, the target sub-member may also be a sub-member selected by the user, and a specific identification process may refer to the similar description in the foregoing embodiment, which will not be repeated here.

Figure 11:
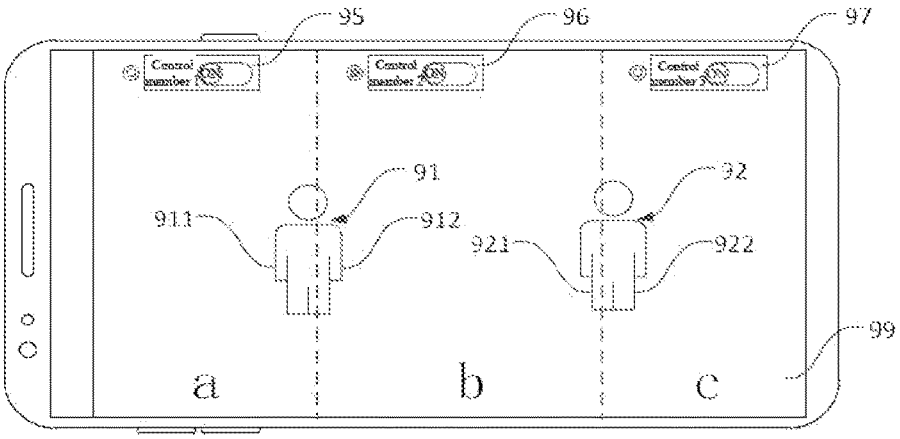
FIG. 11 shows another schematic display diagram of a control member in a screen color gamut control method proposed by the embodiment of the present disclosure.

Specifically, as shown in FIG. 11, when it is detected that the control member 96 is in a selected state by being touched by the user, the control member 96 can be identified as the target sub-member, that is, the acquisition of the target sub-member is realized.

Step S470: switching the color gamut of the screen to be consistent with the color gamut space represented by the target sub-member.

In a screen color gamut control method provided by an embodiment of the present disclosure, by acquiring the application scenario of an electronic device, determining whether the color gamut space configured in the application scenario is consistent with a color gamut space of the screen, in a case of inconsistent, displaying the control member in the sub-region of the display interface of the target application scenario, causing each sub-region displaying the display effect of the corresponding color gamut space adapted to a color gamut space of the screen, so that the color gamut of the screen can be quickly switched to a display effect consistent with the color gamut space represented by the target sub-member, which enhances the user experience.

Figure 12:
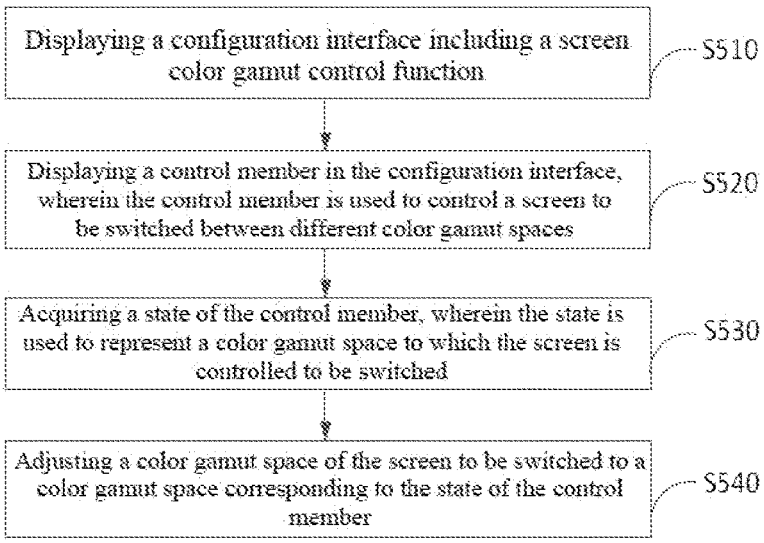
FIG. 12 shows a method flowchart of a screen color gamut control method proposed by still another embodiment of the present disclosure.

Referring to FIG. 12, a screen color gamut control method provided by an embodiment of the present disclosure is applied to an electronic device having a screen, and the screen supports image display based on multiple color gamut spaces, and the method includes:

Step S510: displaying a configuration interface including a screen color gamut control function.

As one way, it can be determined whether the configuration interface including the screen color gamut control function is displayed by detecting whether the present electronic device has turned on a display control member.

Optionally, whether the display control member has turned on may be considered for the electronic device in global, or may be considered for a single application. In such a way for a single application, the electronic device can set a configuration interface, so that the user can control which application programs can turn on the screen color gamut control function, and which application programs do not need to turn on the screen color gamut control function. It needs to explain that, the application program that does not need to turn on the screen color gamut control function can be an application program without the color gamut space switching function or can be an application program with the color gamut space switching function, but the application program does not need to turn on the color gamut space switching function in order to save the power consumption of electronic device or be specified by users. In this case, for an application that the screen color gamut control function is turned on, the electronic device will display a configuration interface including the screen color gamut control function, so that the user can flexibly switch the screen color gamut space.

Whether an application can turn on the screen color gamut control function can be distinguished by establishing a list. Optionally, the application programs that exist in the list can be determined that the screen color gamut control function can be turned on, and application programs that do not exist in the list can be determined that the screen color gamut control function is not turned on. For example, if there are multiple application programs displayed on the interface of the electronic device and the control members having the screen color gamut control function corresponding to the multiple application programs, it can be determined whether these applications exist in the list by determining the state of these control members. Optionally, if the control member is in an turned-on state, it means that the application program corresponding to the control member exists in the list. If the control member is not in the turned-on state, it means that the application program corresponding to the control member does not exist in the list.

It can be understood that displaying the configuration interface including the screen color gamut control function will inevitably consume the resources of the electronic device, in order to reduce the power consumption of the electronic device, the configuration interface can be displayed again in some specific cases, the specific description is provided as follows.

Figure 13:
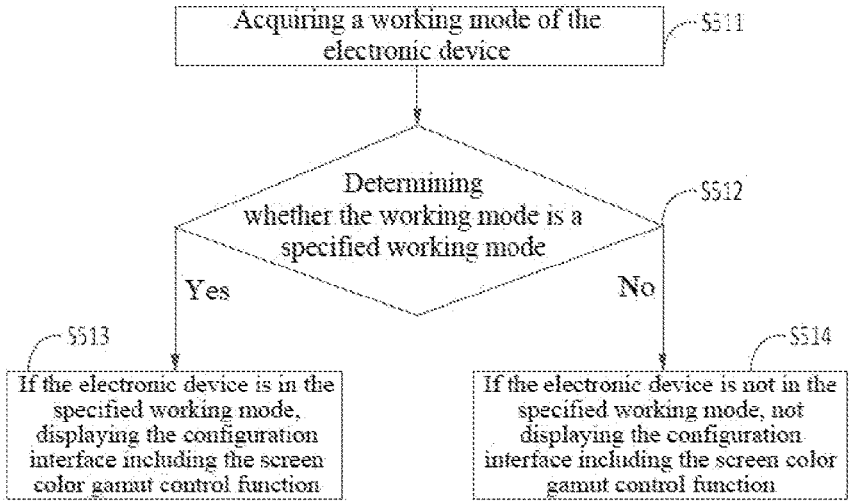
FIG. 13 shows a method flowchart of a specific implementation manner of step S510 of FIG. 12.

As one way, as shown in FIG. 13, step S510 may include:

Step S511: acquiring a working mode of the electronic device.

In this embodiment, the working mode refers to an operating state of the electronic device that affects the processor resources and power resources of the electronic device. For example, the working mode may include a power-saving mode, an ultra-long standby mode, an airplane mode, an eye protection mode, a sleep mode mode, and the like. Optionally, the electronic device may be in two or more working modes at the same time, for example, both in the airplane mode and in the power-saving mode at the same time. The power consumption of the electronic device is different in different working modes. It can be determined whether the aforementioned configuration interface including the screen color gamut control function needs to be displayed by acquiring the working mode of the electronic device, so as to reduce the power consumption of the electronic device.

As one way, a variable can be configured for an application program of the electronic device corresponding to the above-mentioned working mode, and the present working mode of the electronic device can be acquired by identifying the variable value. For example, if the variable value is 1, it means that the electronic device is in a corresponding working mode, and when the variable value is 0, it means that the electronic device is not in the corresponding working mode. Optionally, in a specific implementation, if it is detected that multiple variable values are 1 at the same time, it can be determined that the electronic device is in several corresponding working modes at the same time. It should be noted that for the same type of working mode (for example, the power-saving mode and the ultra power-saving mode), because they are all working modes relative to one application, there will only be one.

As another way, the working mode of the electronic device can also be acquired according to the number of application programs presently running in the foreground by the system; alternatively, the working mode of the electronic device can be acquired according to a network state of the electronic device. Optionally, if the electronic device is an Android operating system, the name of the application presently running in the foreground can be acquired by executing a getRunningTasks method of ActivityManager, and then a number of application programs presently running in the foreground are acquired. If the number of application programs is less than a preset number, then it can be determined that the electronic device is in a power-saving mode or a sleep mode. For example, in the power-saving mode, the electronic device can automatically close (or be manually selected by the user to close) application programs with high power consumption or only keep one or two of the most frequently used application programs and close others to save power. Similarly, when in the sleep mode, the electronic device will also close the application program with the highest power consumption or even close all application programs.

Optionally, the above working mode can be acquired by acquiring the network connection state of the electronic device. If it is detected that a network connection module of the electronic device is in an off state, then it can be determined that the electronic device is in the airplane mode, a shut-down mode, a super power-saving mode, or the like.

Step S512: determining whether the working mode is a specified working mode.

A specified working mode may be configured for the electronic device. Optionally, a representation of the specified working mode may include a working mode that reduces the power consumption of the electronic device, such as a power-saving mode and an ultra-long standby mode. As one way, whether the working mode of the electronic device is the specified working mode can be determined by matching the acquired working mode with the preset specified working mode.

Step S513: if the electronic device is in the specified working mode, displaying the configuration interface including the screen color gamut control function.

Optionally, if the electronic device is in a specified working mode, a configuration interface including a screen color gamut control function is displayed, so that the user can adjust the spatial range of the screen color gamut to reduce power consumption and resource consumption of the electronic device.

Step S514: if the electronic device is not in the specified working mode, not displaying the configuration interface including the screen color gamut control function.

It can be understood that, if the electronic device is not in the specified working mode, the configuration interface including the screen color gamut control function will not be displayed, so that the power consumption caused by displaying the configuration interface including the screen color gamut control function can be reduced.

Figure 14:
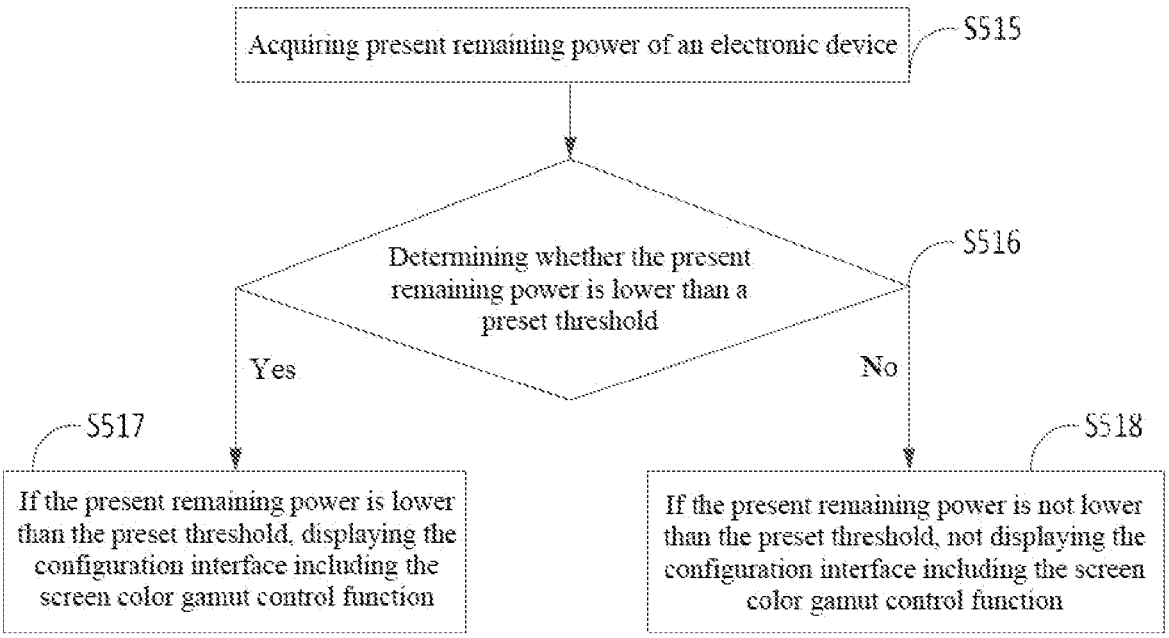
FIG. 14 shows a method flowchart of another specific implementation manner of step S510 in FIG. 12.

As another way, as shown in FIG. 14, step S510 may include:

Step S515: acquiring present remaining power of the electronic device.

It can be understood that if the power of the electronic device is sufficient, adjusting a color gamut space of the screen to match the color gamut space of the display content of the electronic device display interface can improve the display effect of the image content. When battery power of the electronic device is low, if a color gamut space of the screen is also adapted to the color gamut space of the display content of the display interface of the electronic device, the power consumption will be accelerated.

To prolong standby time of the electronic device, as one way, the electronic device in this embodiment can acquire the present remaining power of the electronic device in real time or periodically, so as to adjust a color gamut space of the screen in time to reduce functional loss of the electronic device as much as possible.

Step S516: determining whether the present remaining power is lower than a preset threshold.

A preset threshold can be configured for the battery power. When the preset threshold is reached, a low power warning prompt will be sent to the user, and the user can also be prompted to adjust a color gamut space of the screen to display image content to save the battery power. Optionally, the preset threshold may be 10% of battery power, 15% of battery power, and 20% of battery power, and specific values may be set according to actual conditions, which are not limited here.

In this way, the detected present remaining power can be compared with the power of the preset threshold, so that a color gamut space of the screen can be adjusted in time.

Step S517: if the present remaining power is lower than the preset threshold, displaying the configuration interface including the screen color gamut control function.

Optionally, if the present remaining power is lower than the preset threshold, a configuration interface including the screen color gamut control function can be displayed, so that the user can adjust the spatial range of the screen color gamut to reduce the power consumption and resource consumption of the electronic device.

Step S518: if the present remaining power is not lower than the preset threshold, not displaying the configuration interface including the screen color gamut control function.

Optionally, if the present remaining power is not lower than the preset threshold, the configuration interface including the screen color gamut control function is not displayed, thereby reducing power consumption caused by displaying the configuration interface including the screen color gamut control function.

Step S520: displaying a control member in the configuration interface, wherein the control member is used to control a screen to be switched between different color gamut spaces.

Step S530: acquiring a state of the control member, wherein the state is used to represent a color gamut space of the screen switched to.

Step S540: switching a color gamut space of the screen to a color gamut space corresponding to the state of the control member.

A screen color gamut control method provided by an embodiment of the present disclosure realizes that in a case of a control member being displayed, a color gamut space of the screen is adjusted by the control member, so that the power consumption of the electronic device is reduced and the user experience is improved.

Figure 15:
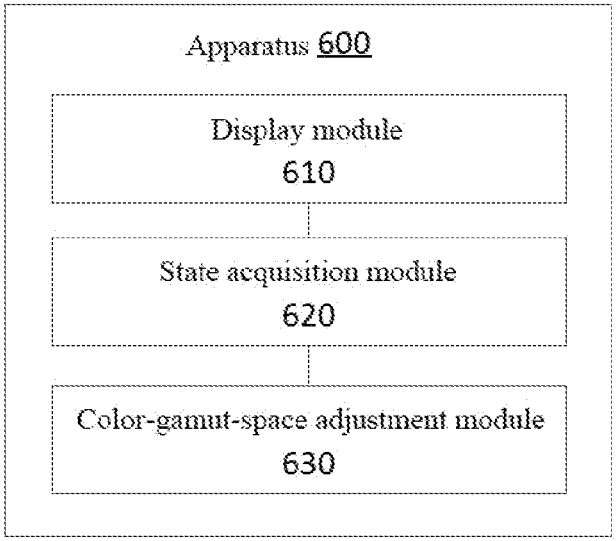
FIG. 15 shows a structural block diagram of a screen color gamut control apparatus proposed by an embodiment of the present disclosure.

Referring to FIG. 15, a screen color gamut control apparatus 600 provided by an embodiment of the present disclosure operates in an electronic device having a screen, wherein the screen supports image display based on multiple color gamut spaces, and the apparatus 600 includes:

A display module 610 is used to display a control member used to control the screen to be switched between different color gamut spaces.

As one way, the display module 610 is specifically configured to acquire an application scenario of the electronic device; to determine whether the color gamut space configured in the application scenario is consistent with a color gamut space of the screen; if inconsistent, displaying a control member.

Optionally, in one way, if the application scenario is a target application scenario, the control member includes a plurality of settings, each of the settings corresponds to one state of the control member. Specifically, the display module 610 can be used to display a control member on the interface of the target application scenario in a stack-up manner; to acquire a target setting, wherein the color gamut space represented by the state of the control member corresponding to the target setting is consistent with a color gamut space configured by the application scenario; to display the recommendation information at the position corresponding to the target setting, wherein the recommendation information is used to recommend that the user switch a color gamut space of the screen to a color gamut space configured by the application scenario.

Optionally, in another way, the control member may include a plurality of separate sub-members, wherein each sub-member corresponds to one state of the control member. If the application scenario is a target application scenario, the display module 610 can be specifically used to divide the interface of the application scenario into a plurality of sub-regions to display a corresponding sub-member on each of the sub-regions in a stack-up manner; to cause each of the sub-regions to display a display effect that a corresponding color gamut space is adapted to the color gamut space of the screen; to acquire a target sub-member, wherein the target sub-member is the sub-member that is selected and has been detected; and to switch the color gamut space of the screen to be consistent with the color gamut space represented by the target sub-member.

In another manner, the display module 610 is specifically configured to display a configuration interface including a screen color gamut control function; and to display the control member in the configuration interface. In an implementation, the working mode of the electronic device can be acquired; if the electronic device is in a specified working mode, a configuration interface including a screen color gamut control function is displayed. In another implementation manner, the present remaining power of the electronic device can be acquired; if the present remaining power is lower than a preset threshold, a configuration interface including a screen color gamut control function is displayed.

A state acquisition module 620 is used to acquire a state of the control member, wherein the state is used to characterize a color gamut space of the screen switched to.

A color-gamut-space adjustment module 630 is used to adjust a color gamut space of the screen to be switched to a color gamut space corresponding to the state of the control member.

It should be noted that the apparatus embodiments in the present disclosure correspond to the foregoing method embodiments, and the specific principles in the apparatus embodiments may refer to the content in the foregoing method embodiments, which will not be repeated here.

An electronic device provided by the present disclosure will be described below with reference to FIG. 16.

Figure 16:
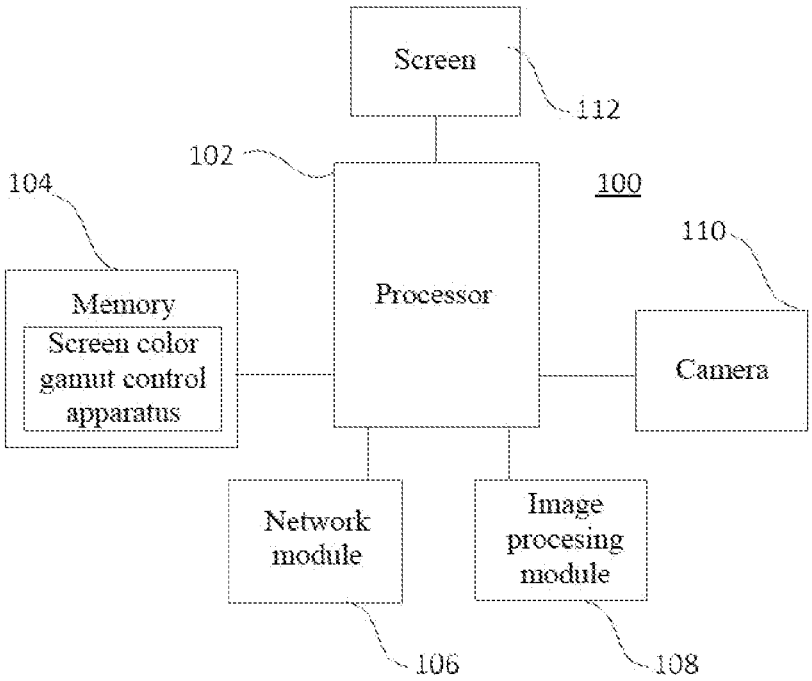
FIG. 16 shows a structural block diagram of an electronic device of the present disclosure for performing a screen color gamut control method according to an embodiment of the present disclosure.

Referring to FIG. 16, based on the above-mentioned method and screen color gamut control apparatus, an embodiment of the present disclosure further provides another electronic device 100 that can perform the aforementioned screen color gamut control method. The electronic device 100 includes one or more (only one shown in the figure) processors 102, a memory 104, a network module 106, a processing module 108, a camera 110, and a screen 112 that are coupled to each other and support image display based on multiple color gamut spaces. The memory 104 stores programs that can execute the content in the foregoing embodiments. The processor 102 can execute the programs stored in the memory 104. The memory 104 includes the apparatus 600 described in the foregoing embodiments.

The processor 102 may include one or more processing cores. The processor 102 uses various interfaces and lines to connect various parts of the entire electronic device 100 and executes various functions of the electronic device 100 and processing data by running or executing the instructions, programs, code sets, or instruction sets stored in the memory 104 and calling the data stored in the memory 104. Optionally, the processor 102 may be implemented by at least one hardware form of a digital signal processing (DSP), a field-programmable gate array (FPGA), and a programmable logic array (PLA). The processor 102 may integrate one or a combination of a central processing unit (CPU), a graphics processing unit, (GPU), a modem, and the like. The CPU mainly handles an operating system, a user interface, application programs, and the like; the GPU is used for rendering and drawing of the display content; the modem is used to handle wireless communication. It can be understood that the above-mentioned modem may not be integrated into the processor 102 and is implemented by a communication chip alone.

The memory 104 may include a random access memory (RAM), or may include a read-only memory (Read-Only Memory). The memory 104 may be used to store instructions, programs, codes, code sets, or instruction sets, e.g., a screen gamut control apparatus may be stored in the memory 104. The transmission control apparatus may be the aforementioned apparatus 600. The memory 104 may include a stored program area and a stored data area, wherein the stored program area may store instructions for implementing the operating system, instructions for implementing at least one function (such as a touch function, a sound playback function, and a video image playback function), instructions for implementing the foregoing method embodiments, and the like. The storage data area may also store data (such as phone book, audio and video data, chat record data) created by the electronic device 100 during use.

The network module 106 is used for receiving and sending electromagnetic waves, realizing mutual conversion between electromagnetic waves and electrical signals, so as to communicate with a communication network or other devices, for example, communicate with an audio playback device. The network module 106 may include various existing circuit elements for performing these functions, e.g., antennas, radio frequency transceivers, digital signal processors, encryption/decryption chips, subscriber identity module (SIM) cards, memory, etc. The network module 106 can communicate with various networks such as the Internet, an intranet, a wireless network, or communicate with other devices through a wireless network. The aforementioned wireless network may include a cellular telephone network, a wireless local area network, or a metropolitan area network. For example, the network module 106 may perform information interactions with a base station.

The image processing module 108 can be used to encode the image captured by the camera 110 or decode the data requested by the network module 106 from the network, so as to be transmitted to the screen 112 for display. Specifically, the image processing module 108 may be a GPU, a dedicated DSP, an FPGA, an ASIC chip, or the like.

Figure 17:
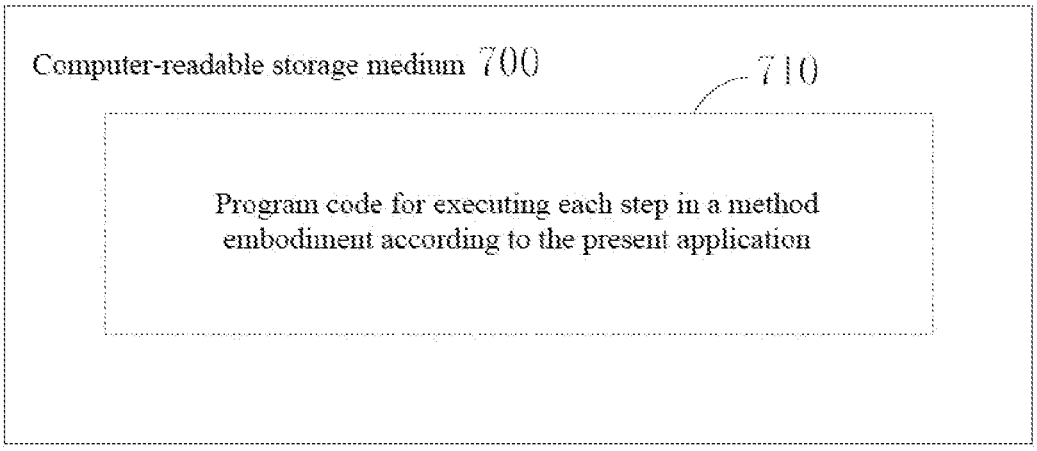
FIG. 17 is a storage unit according to an embodiment of the present disclosure for storing or carrying a program code for implementing a screen color gamut control method according to an embodiment of the present disclosure.

Please refer to FIG. 17, which shows a structural block diagram of a computer-readable storage medium provided by an embodiment of the present disclosure. The computer-readable medium 700 stores program codes, wherein the program codes can be called by the processor to execute the methods described in the above method embodiments.

The computer-readable storage medium 700 may be an electronic memory such as flash memory, EEPROM (Electrically Erasable Programmable Read-Only Memory), EPROM, hard disk, or ROM. Optionally, the computer-readable storage medium 700 includes a non-transitory computer-readable storage medium. The computer-readable storage medium 700 has a storage space for program code 710 to perform any of the method steps in the above-described methods. These program codes can be read from or written to one or more computer program products. Program code 710 may be compressed, for example, in a suitable form.

In summary, a screen color gamut control method, apparatus, electronic device, and storage medium are provided in the present disclosure, by displaying a control member configured to control the screen to be switched between different color gamut spaces, then acquiring a state of the control member, wherein the state is configured to represent a color gamut space of the screen switched to, and then switching a color gamut space of the screen to a color gamut space corresponding to the state of the control member. By the present method, it can make that in a case of the control member being displayed, a color gamut space of the screen is adjusted by the control member to switch the color gamut space to that corresponding to the state of the control member, so that users can enjoy different color experiences, thereby improving user experience.

Finally, it should be noted that the above embodiments are only used to illustrate the technical solutions of the present disclosure, but not to limit the present disclosure; although the present disclosure has been described in detail with reference to the foregoing embodiments, those of ordinary skill in the art should understand that it can still be modifications made to the technical solutions described in the foregoing embodiments, or some technical features thereof that are equivalently replaced; and these modifications or replacements do not drive the essence of the corresponding technical solutions to deviate from the spirit and scope of the technical solutions of the embodiments of the present disclosure.

What is claimed is:

1. A screen color gamut control method, for an electronic device comprising a screen supporting image display based on multiple color gamut spaces, method comprising:

displaying a control member configured to switch color gamut spaces of the screen;

acquiring a state of the control member, the state being configured to represent a color gamut space of the screen switched to; and switching the color gamut space of the screen to a color gamut space corresponding to the state of the control member;

wherein the displaying the control member comprises:

acquiring an application scenario of the electronic device, wherein the application scenario is a content scene corresponding to an application program displayed on a display interface of the electronic device;

determining whether a color gamut space configured by the application scenario is consistent with the current color gamut space of the screen by comparing whether the current color gamut space of the screen is consistent with the color gamut space configured in a content interface of the application program acquired by reading a configuration file encapsulated in an installation file of the application program; and displaying the control member in response to determining being inconsistent, or not displaying the control member in response to determining being consistent.

2. The method as claimed in claim 1, wherein in response to the application scenario being a target application scenario, the control member comprises a plurality of settings, each setting corresponds to one state of the control member, and the displaying the control member further comprises:

displaying the control member on an interface of the target application scenario in a stack-up manner;

acquiring a target setting, wherein a color gamut space represented by the state of the control member corresponding to the target setting is consistent with the color gamut space configured by the application scenario; and displaying recommendation information at a position corresponding to the target setting, wherein the recommendation information is configured to recommend a user to switch the color gamut space of the screen to the color gamut space configured by the application scenario.

3. The method as claimed in claim 2, wherein the acquiring the target setting comprises:

acquiring a color gamut space configured by contents displayed on a present interface;

determining the control member corresponding to a screen color gamut space consistent with the color gamut space as a target control member; and defining a setting where the target control member locates as the target setting.

4. The method as claimed in claim 1, wherein the control member comprises a plurality of separate sub-members, each sub-member corresponds to one state of the control member, and in response to the application scenario being a target application scenario, the displaying the control member further comprises:

dividing an interface of the application scenario into a plurality of sub-regions, wherein a corresponding sub-member is displayed on each of the sub-regions in a stack-up manner to make the color gamut space represented by the sub-member corresponding to each of the sub-regions serve as a color gamut space corresponding to each of the sub-regions;

causing each of the sub-regions to display a display effect that a corresponding color gamut space is adapted to the color gamut space of the screen;

acquiring a target sub-member, wherein the target sub-member is the sub-member that is selected and has been detected; and switching the color gamut space of the screen to be consistent with the color gamut space represented by the target sub-member.

5. An electronic device, comprising:

one or more processors; and memory configured to store instructions which, when executed by the one or more processors, cause the one or more processors to perform a method comprising:

displaying a control member configured to switch color gamut spaces of the screen;

acquiring a state of the control member, the state being configured to represent a color gamut space of the screen switched to; and switching the color gamut space of the screen to a color gamut space corresponding to the state of the control member;

wherein the displaying the control member comprises:

acquiring an application scenario of the electronic device, wherein the application scenario is a content scene corresponding to an application program displayed on a display interface of the electronic device;

determining whether a color gamut space configured by the application scenario is consistent with the current color gamut space of the screen by comparing whether the current color gamut space of the screen is consistent with the color gamut space configured in a content interface of the application program acquired by reading a configuration file encapsulated in an installation file of the application program; and displaying the control member in response to determining being inconsistent, or not displaying the control member in response to determining being consistent.

6. The electronic device as claimed in claim 5, wherein in response to the application scenario being a target application scenario, the control member comprises a plurality of settings, each setting corresponds to one state of the control member, and the displaying the control member further comprises:

displaying the control member on an interface of the target application scenario in a stack-up manner;

acquiring a target setting, wherein a color gamut space represented by the state of the control member corresponding to the target setting is consistent with the color gamut space configured by the application scenario; and displaying recommendation information at a position corresponding to the target setting, wherein the recommendation information is configured to recommend a user to switch the color gamut space of the screen to the color gamut space configured by the application scenario.

7. The electronic device as claimed in claim 6, wherein the acquiring the target setting comprises:

acquiring a color gamut space configured by contents displayed on a present interface;

determining the control member corresponding to a screen color gamut space consistent with the color gamut space as a target control member; and defining a setting where the target control member locates as the target setting.

8. The electronic device as claimed in claim 5, wherein the control member comprises a plurality of separate sub-members, each sub-member corresponds to one state of the control member, and in response to the application scenario being a target application scenario, the displaying the control member further comprises:

dividing an interface of the application scenario into a plurality of sub-regions, wherein a corresponding sub-member is displayed on each of the sub-regions in a stack-up manner to make the color gamut space represented by the sub-member corresponding to each of the sub-regions serve as a color gamut space corresponding to each of the sub-regions;

causing each of the sub-regions to display a display effect that a corresponding color gamut space is adapted to the color gamut space of the screen;

acquiring a target sub-member, wherein the target sub-member is the sub-member that is selected and has been detected; and switching the color gamut space of the screen to be consistent with the color gamut space represented by the target sub-member.

9. A non-transitory computer-readable storage medium having stored therein instructions that, when executed by a processor, cause the processor to perform a method comprising:

displaying a control member configured to switch color gamut spaces of the screen;

acquiring a state of the control member, the state being configured to represent a color gamut space of the screen switched to; and switching the color gamut space of the screen to a color gamut space corresponding to the state of the control member;

wherein the displaying the control member comprises:

acquiring an application scenario of the electronic device, wherein the application scenario is a content scene corresponding to an application program displayed on a display interface of the electronic device;

determining whether a color gamut space configured by the application scenario is consistent with the current color gamut space of the screen by comparing whether the current color gamut space of the screen is consistent with the color gamut space configured in a content interface of the application program acquired by reading a configuration file encapsulated in an installation file of the application program; and displaying the control member in response to determining being inconsistent, or not displaying the control member in response to determining being consistent.

* * * * *